US007210490B2

(12) United States Patent
Ko

(10) Patent No.: US 7,210,490 B2
(45) Date of Patent: May 1, 2007

(54) SUPER MINI UMBRELLA

(76) Inventor: Chin Sung Ko, No. 38, Din Nan Road, Homei Town, Changhua Shien (TW)

( * ) Notice: Subject to any disclaimer, the term of this patent is extended or adjusted under 35 U.S.C. 154(b) by 142 days.

(21) Appl. No.: 11/010,426

(22) Filed: Dec. 14, 2004

(65) Prior Publication Data

US 2006/0124159 A1 Jun. 15, 2006

(51) Int. Cl.
*A45B 25/14* (2006.01)

(52) U.S. Cl. ..... 135/24; 135/25.4

(58) Field of Classification Search ..... 135/24, 135/25.4, 25.41, 28, 44, 48; D3/12, 17; 16/427, 16/110.1, 111.1, 405–407, 436; 40/608
See application file for complete search history.

(56) References Cited

U.S. PATENT DOCUMENTS 3,640,298 A * 2/1972 Weber ..... 135/25.1
3,678,949 A * 7/1972 Weber ..... 135/25.3
3,732,881 A * 5/1973 Hirai ..... 135/22
3,760,827 A * 9/1973 Weber ..... 135/44
3,774,627 A * 11/1973 Seitel ..... 135/25.4
3,831,614 A * 8/1974 Weber ..... 135/26
3,851,657 A * 12/1974 Weber ..... 135/25.4
3,890,990 A * 6/1975 Schafer ..... 135/15.1
5,301,703 A * 4/1994 Kahn ..... 135/77
5,533,535 A * 7/1996 Lin et al. ..... 135/20.1
5,964,451 A * 10/1999 Sudheimer ..... 254/132

FOREIGN PATENT DOCUMENTS

JP 2002-336018 * 11/2002

* cited by examiner

*Primary Examiner*—Winnie Yip
(74) *Attorney, Agent, or Firm*—Rosenberg, Klein & Lee

(57) ABSTRACT

The invention relates to a super mini umbrella, which has a shorter length for facilitating carrying by people. The umbrella includes a shaft having its lowest tube with many impressions covered with glue to insert into a connector in a handle of the umbrella. A runner of the umbrella is thus capable of being moved around the connector when the umbrella is closed that can decrease the length of the closed umbrella perfectly.

6 Claims, 6 Drawing Sheets

SUPER MINI UMBRELLA

FIELD OF THE INVENTION

The present invention relates to a super mini umbrella, which has a shorter length than any prior one as it is closed.

BACKGROUND OF THE INVENTION

As shown in FIG. 1, it shows a conventional mini umbrella, which is designed for facilitating carrying by people, in the event that it is so small when closed. The conventional umbrella includes an umbrella frame (1), a runner (2), and a shaft (3) having multiple tubes. The shaft (3) has its lowest tube (31) insert into a connector (41) in a handle (4) of the umbrella and a pin (42) is provided for connecting both together firmly.

SUMMARY OF THE INVENTION

The present invention is to provide a super mini umbrella to improve the known mini umbrella for obtaining a shorter length of the closed umbrella for facilitating carrying. Now, accompanying with the following drawings, the character of the present invention will be described here and after.

DETAILED DESCRIPTION OF THE PREFERRED EMBODIMENT

Figure 1:
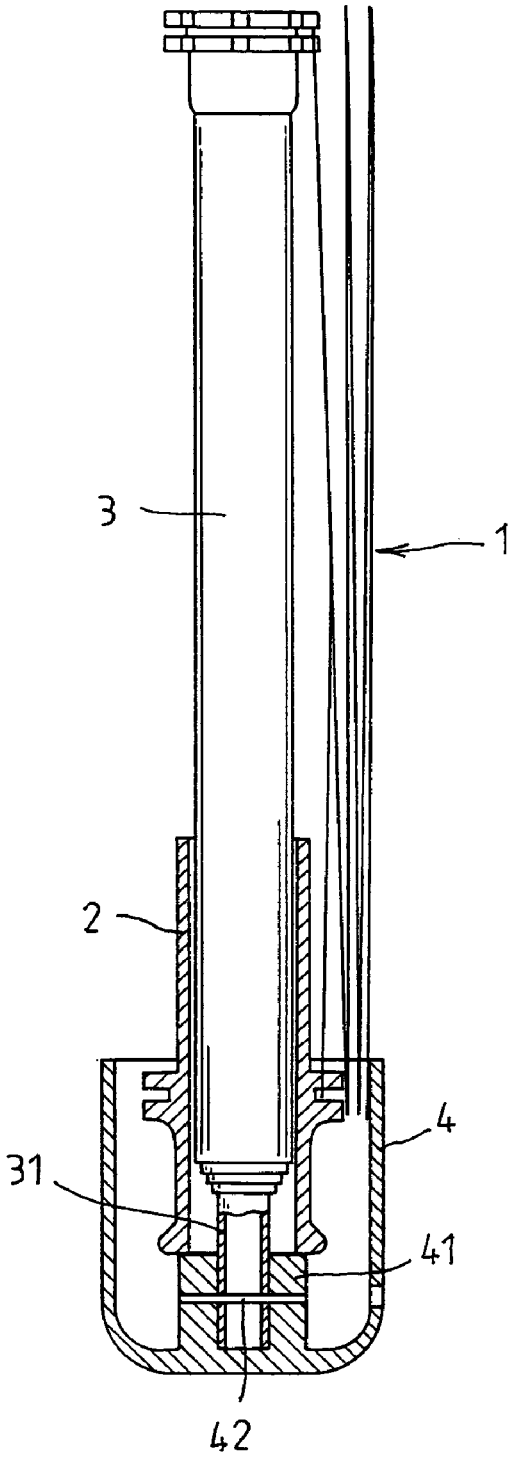
FIG. 1 (prior art)
FIG. 1 is a cross-sectional plan view showing a conventional mini umbrella in closed state.
Figure 2:
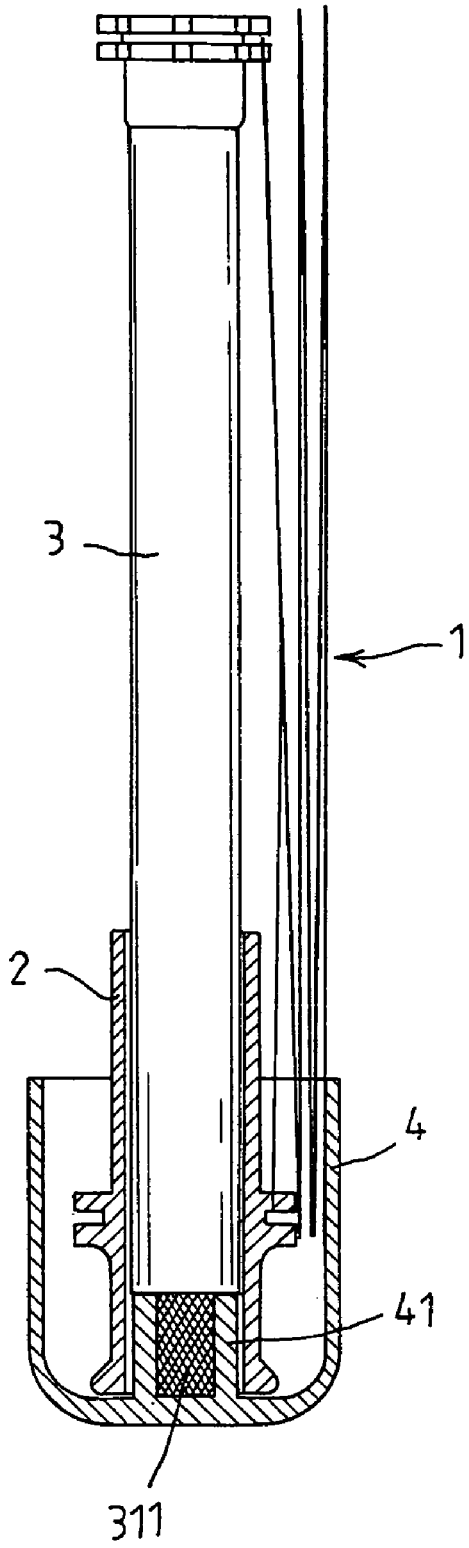
FIG. 2 is a cross-sectional plan view showing a super mini umbrella in closed state according to the present invention.
Figure 3:
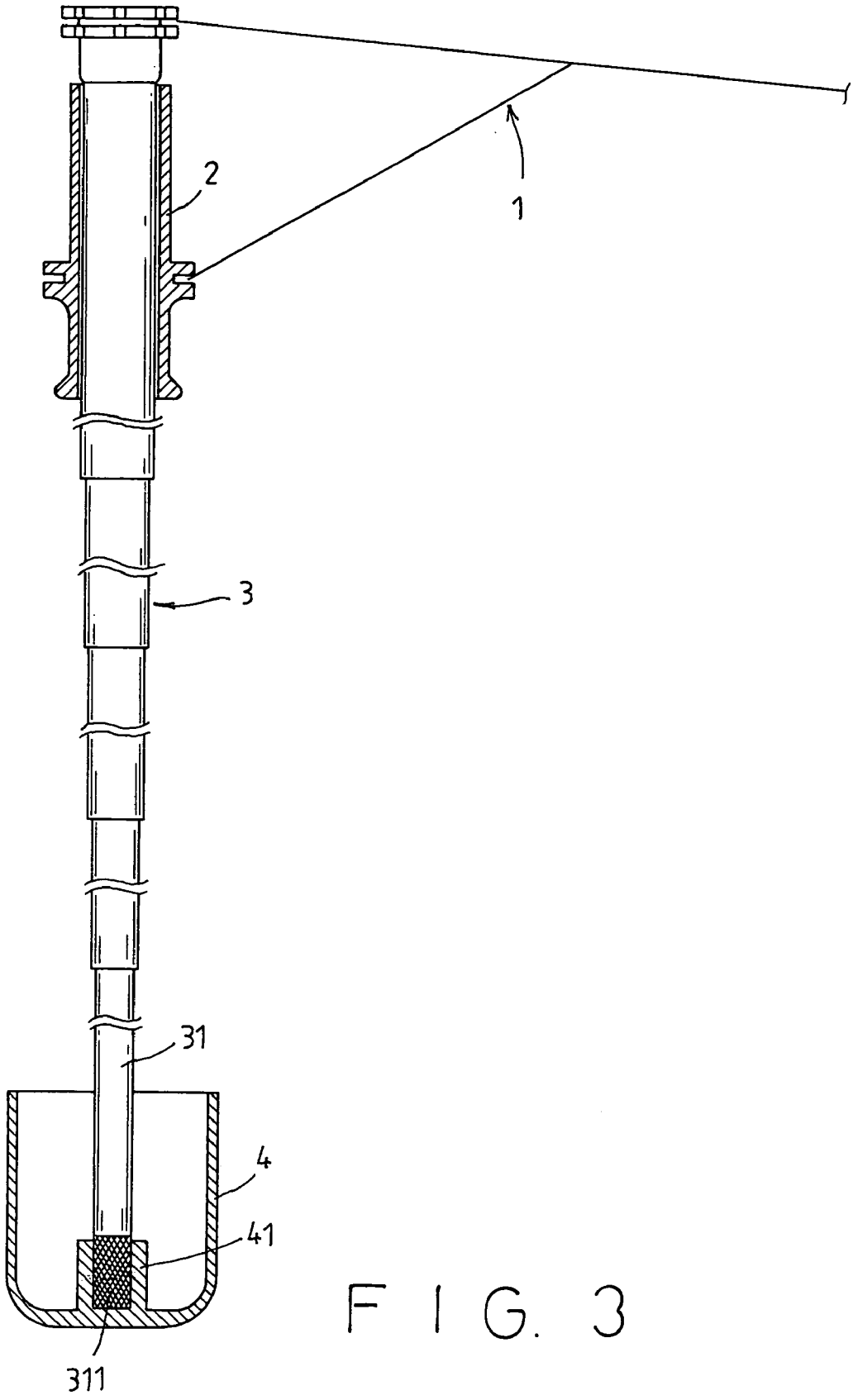
FIG. 3 is a plan view of FIG. 2 showing the umbrella in opened state.
Figure 4:
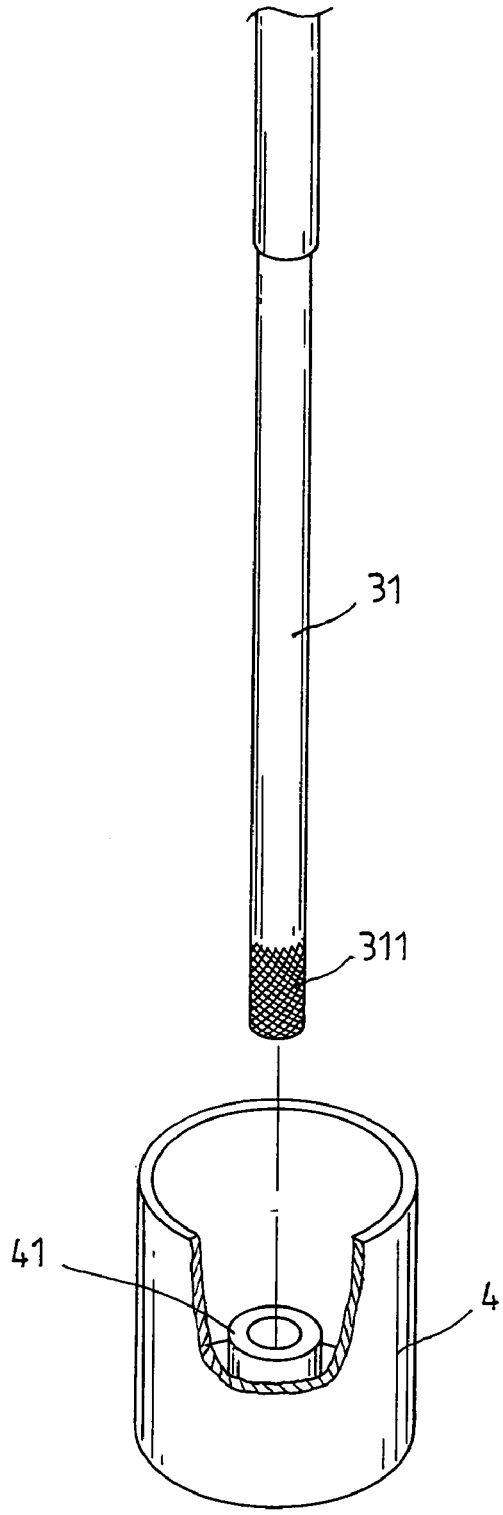
FIG. 4 is a perspective view showing parts of a shaft and a handle of the super mini umbrella according to the present invention.

Please refer to FIG. 2 and 4, the present invention relates to a super mini umbrella, which includes a frame (1), a runner (2), a shaft (3) having multiple tubes, and a handle (4). The improvement of the present invention is that the shaft (3) has its lowest tube (31) being graved with many impressions (311). The lowest tube (31) can be inserted into a central hole (411) of a connector (41) in the handle (4), while glue is provided on the tube (31). By use of glue remained in the impressions (311), the tube (31) is capable of being connected within the connector (41) securely without a pin (42) of prior art. The manufacturing of this procedure will be more convenient. Furthermore, since the pin (42) is not necessary in the present invention, the connector (41) is designed to have a smaller diameter. Hence, the runner (2) can be moved downward to position around the connector (41) when the umbrella is closed that will decrease the length and obtains the purpose of this invention.

Figure 5:
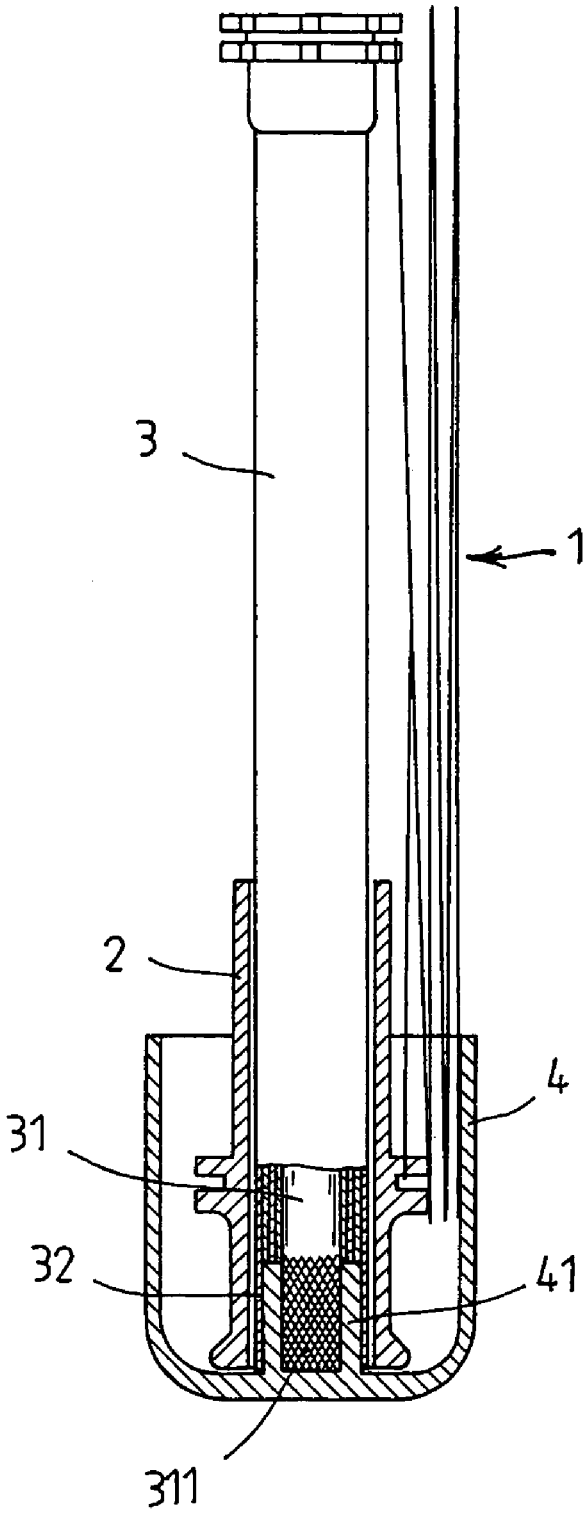
FIG. 5 is a cross-sectional plan view showing another embodiment relating to FIG. 2 according to the present invention.
Figure 6:
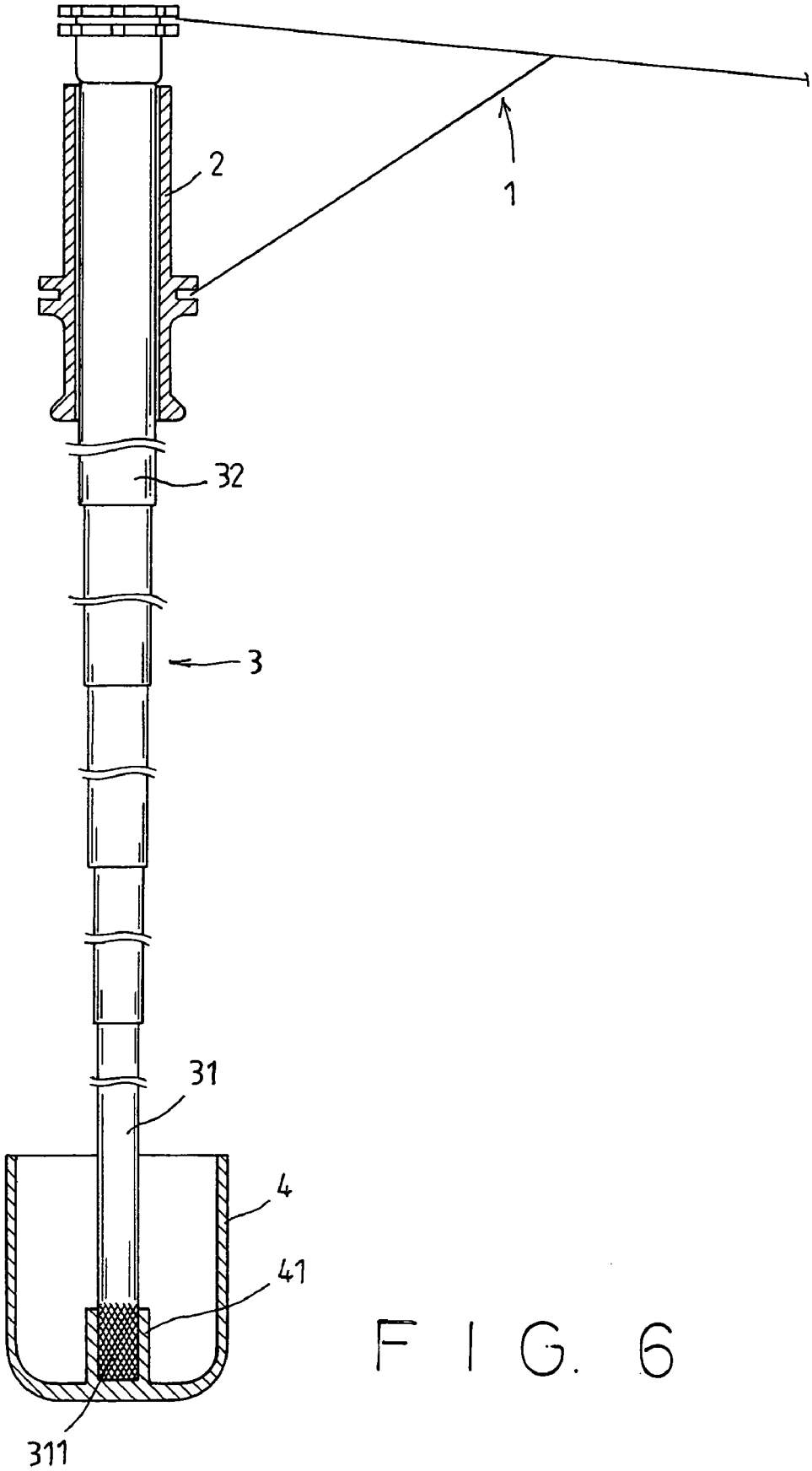
FIG. 6 is a plan view of FIG. 5 showing the umbrella in opened state.

In another performance, as shown in FIG. 5 and 6, the connector (41) has a still smaller diameter in order that the top tube (39) can position around the connector (41) also when the umbrella is closed. This structure provides an umbrella having a shortened length than former.

I claim:

1. A super mini umbrella comprising:

a shaft having a first end and a second opposing end, said shaft having a plurality of telescopic tubes, said plurality of telescopic tubes including at least an upper telescopic tube and a lower telescopic tube;

a frame coupled to said shaft;

a runner coupled to said shaft and slidably displaceable thereon, said runner having a first diameter;

a handle coupled to said second opposing end of said shaft, said handle including a connector having a central hole for coupling with said lower telescopic tube, said connector having a second diameter, said second diameter being less than said first diameter of said runner, wherein when the umbrella is in a closed position said connector is fully received within said runner.

2. The super mini umbrella as recited in claim 1, wherein said lower telescopic tube has a roughened surface.

3. The super mini umbrella as recited in claim 2, wherein said lower telescopic tube roughened surface is adhesively coupled to said connector.

4. A super mini umbrella comprising:

a shaft having a first end and a second opposing end, said shaft having a plurality of telescopic tubes, said plurality of telescopic tubes including at least an upper telescopic tube and lower telescopic tube, said upper telescopic tube having a first diameter;

a frame coupled to said shaft;

a runner coupled to said shaft and slidably displaceable thereon;

a handle coupled to said second opposing end of said shaft, said handle including a connector having a central hole for coupling with said lower telescopic tube, said connector having a second diameter, said second diameter being less than said first diameter, wherein when the umbrella is in a closed position, said connector is fully received within said upper telescopic tube.

5. The super mini umbrella as recited in claim 3, wherein said lower telescopic tube has a roughened surface.

6. The super mini umbrella as recited in claim 5, wherein said lower telescopic tube roughened surface is adhesively coupled to said connector.

* * * * *